US007854297B2

(12) United States Patent
Scanlon

(10) Patent No.: US 7,854,297 B2
(45) **Date of Patent: *Dec. 21, 2010**

(54) MUFFLER AND RELATED SYSTEMS

(75) Inventor: Michael Scanlon, Laurel, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 538 days.

This patent is subject to a terminal disclaimer.

(21) Appl. No.: 11/790,053

(22) Filed: Apr. 23, 2007

(65) Prior Publication Data

US 2007/0284178 A1 Dec. 13, 2007

Related U.S. Application Data

(63) Continuation-in-part of application No. 11/009,855, filed on Dec. 10, 2004, now Pat. No. 7,207,258.

(51) Int. Cl.
*F01N 1/02* (2006.01)
*F01N 1/08* (2006.01)
*F01N 1/00* (2006.01)

(52) U.S. Cl. ..... 181/250; 181/274

(58) Field of Classification Search ..... 181/250, 181/249, 255, 266, 267, 269, 272, 273, 274, 181/276, 279, 223, 280
See application file for complete search history.

(56) References Cited

U.S. PATENT DOCUMENTS 2,068,686 A * 1/1937 Lascroux ..... 181/274
2,233,341 A * 2/1941 Cary ..... 181/250
2,247,130 A * 6/1941 McCurdy ..... 181/239
2,251,369 A * 8/1941 Moss ..... 181/250
2,403,403 A * 7/1946 Sauer ..... 181/274
2,445,045 A * 7/1948 Strachan ..... 181/280
2,476,470 A * 7/1949 Willas ..... 181/274
2,511,597 A * 6/1950 Marx ..... 181/274
2,788,078 A * 4/1957 Reindl ..... 181/255
2,903,085 A * 9/1959 Miller ..... 181/255
3,209,858 A * 10/1965 Jettinghoff ..... 181/266
3,374,858 A * 3/1968 Richards ..... 181/274
3,680,660 A * 8/1972 DuBois ..... 181/250
3,779,339 A * 12/1973 Johnson ..... 181/276
4,050,539 A * 9/1977 Kashiwara et al. ..... 181/280
4,162,904 A * 7/1979 Clay et al. ..... 96/381

(Continued)

*Primary Examiner*—Edgardo San Martin
(74) *Attorney, Agent, or Firm*—William V. Adams; Alan I. Kalb

(57) ABSTRACT

Mufflers are provided for a vehicle exhaust system having a combustion chamber and an exhaust pipe. The vehicle exhaust system is configured to reduce the noise of combustion gasses generated in the combustion chamber. An exemplary muffler includes a proximal end and a distal end, the proximal end being configured for mounting the muffler to the exhaust pipe leading to the engine, the distal end being configured to allow the combustion gasses to pass therethrough, and at least one vortex chamber disposed between the proximal end and the distal end. The at least one vortex chamber includes a circular peripheral wall for inducing a vortex on a portion of the combustion gasses expelled from the combustion chamber during high-pressure pulsations created by the operation of a vehicle engine. The vortex impedes flow of the combustion gasses from the pipe such that acoustic energy associated with the expulsion of the combustion gasses is dissipated.

9 Claims, 9 Drawing Sheets

U.S. PATENT DOCUMENTS 4,244,442 A * 1/1981 Scarton et al. ..... 181/230
4,285,916 A * 8/1981 Baisden ..... 423/212
4,335,644 A * 6/1982 Goes et al. ..... 89/198
4,346,783 A * 8/1982 Scarton et al. ..... 181/230
4,588,043 A * 5/1986 Finn ..... 181/223
4,685,534 A * 8/1987 Burstein et al. ..... 181/251
5,029,512 A * 7/1991 Latka ..... 89/14.4
5,311,907 A * 5/1994 Houck ..... 137/810
5,824,972 A * 10/1998 Butler ..... 181/279
6,296,074 B1 * 10/2001 Ridlen ..... 181/272
6,308,609 B1 * 10/2001 Davies ..... 89/14.4
6,385,967 B1 * 5/2002 Chen ..... 60/312
6,588,545 B1 * 7/2003 Lee ..... 181/264
6,959,782 B2 * 11/2005 Brower et al. ..... 181/272
7,117,973 B2 * 10/2006 Graefenstein ..... 181/253
7,207,258 B1 * 4/2007 Scanlon ..... 89/198
7,357,221 B2 * 4/2008 Maier ..... 181/268
7,412,917 B2 * 8/2008 Vais ..... 89/14.4
2007/0012511 A1 * 1/2007 Wall ..... 181/279

* cited by examiner

MUFFLER AND RELATED SYSTEMS

This patent application is a continuation-in-part of U.S. patent application Ser. No. 11/009,855, filed on 10 Dec. 2004 now U.S. Pat. No. 7,207,258, the contents of which are incorporated herein by reference.

GOVERNMENT INTEREST

The invention described herein may be manufactured, used, and licensed by or for the United States Government.

BACKGROUND

1. Technical Field

The present disclosure generally relates to mufflers and vehicle exhaust systems for quieting combustion chamber noise.

2. Description of the Related Art

Many known combustion engines utilize expanding high-pressure combustion gasses to move a piston. Ignition of the fuel creates high-pressure pulses of combustion gasses that exit the engine manifold and travel down pipes to a muffler that helps reduce the noise from the engine. When the combustion gasses, also referred to herein as the exhaust gasses or exhaust gas, exit the tailpipe of a vehicle engine noises are heard. The rapid pressurization and subsequent depressurization of the exhaust system caused by the high-pressure pulses create a loud sound. As would be expected, the louder the noise, the more significant the annoyance factor and more potential damage to hearing.

The use of mufflers with combustion engines to reduce the amplitude of the acoustic energy of the exhausting gas is known. A typical muffler is located along an exhaust pipe and provides a large expansion volume compared to the pipe. With the muffler in place, the pressurized combustion gasses have a relatively large volume into which to expand. As the combustion gasses expand into the volume of the muffler, the pressure of those gasses falls significantly. Therefore, as the exhausting gas finally exits the muffler, the pressure of the combustion gasses being released to the atmosphere is significantly lower than the pressure of the combustion gasses when a muffler is not used. By reducing the peak amplitude of the combustion gas pressure released to the atmosphere, the sound of the vehicle exhaust system is much softer.

Many existing mufflers are typically of complex construction. For example, many mufflers have small orifices or diffusion materials that may become fouled by residue deposited as combustion gasses pass through the muffler. Fouling of these parts and variances during the life of the vehicle exhaust system may cause reduced efficiency and/or total inoperability of the muffler. Many existing mufflers also require the use of baffling materials for the reduction of the exhaust noise.

SUMMARY

Briefly described, devices and systems involving a muffler for use with a vehicle exhaust system are disclosed. A representative embodiment of a muffler is provided for a vehicle exhaust system that has a combustion chamber and an exhaust pipe that the exhaust gas travels through before passing through the said muffler. The vehicle exhaust system is configured to emit exhausting gasses with minimal backpressure. The muffler also includes a proximal end and a distal end, the proximal end being configured for mounting the muffler to the pipe leading to the engine, the distal end being configured to allow the exhausting gasses to pass therethrough to vent into the atmosphere. The muffler includes at least one vortex chamber disposed between the proximal end and the distal end, the at least one vortex chamber including a circular peripheral wall for inducing a vortex on a portion of the combustion gasses during passage through the system.

The vehicle exhaust system includes a combustion chamber, an exhaust pipe for guiding the exhausting gasses along an exhaust gas path, and a muffler. The muffler includes a proximal end and a distal end, the proximal end being configured for mounting the muffler to the pipe, the distal end being configured to allow the exhausting gasses to pass therethrough, and at least one vortex chamber disposed between the proximal end and the distal end. The at least one vortex chamber includes a circular peripheral wall for inducing a vortex on a portion of the combustion gasses during emission.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

The components in the drawings are not necessarily to scale. Moreover, in the drawings, like reference numerals designate corresponding parts throughout the several views.

DETAILED DESCRIPTION

Figure 1:
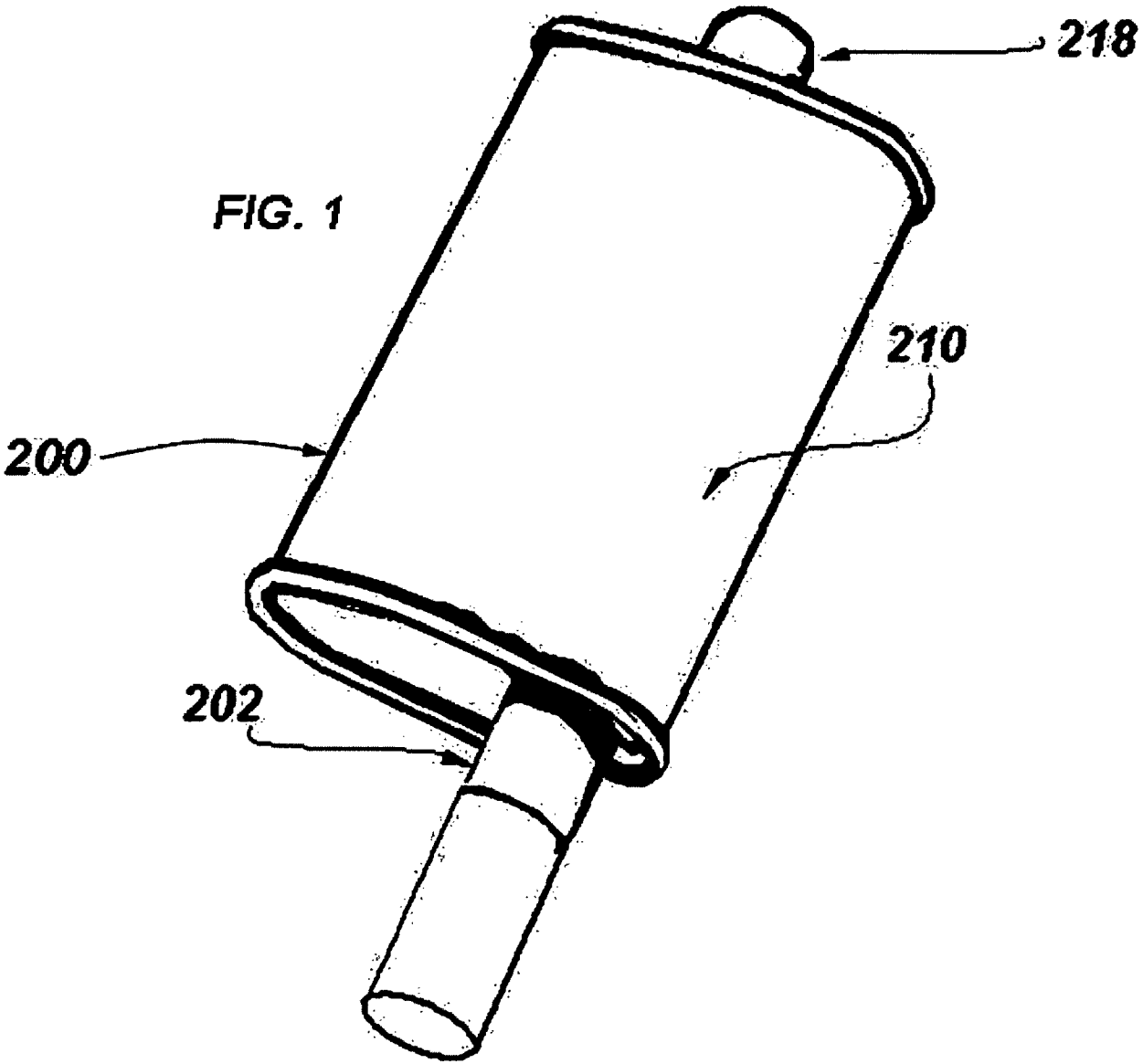
FIG. 1 is a side view of an embodiment of a vehicle exhaust system that includes an embodiment of a muffler.
Figure 2A:
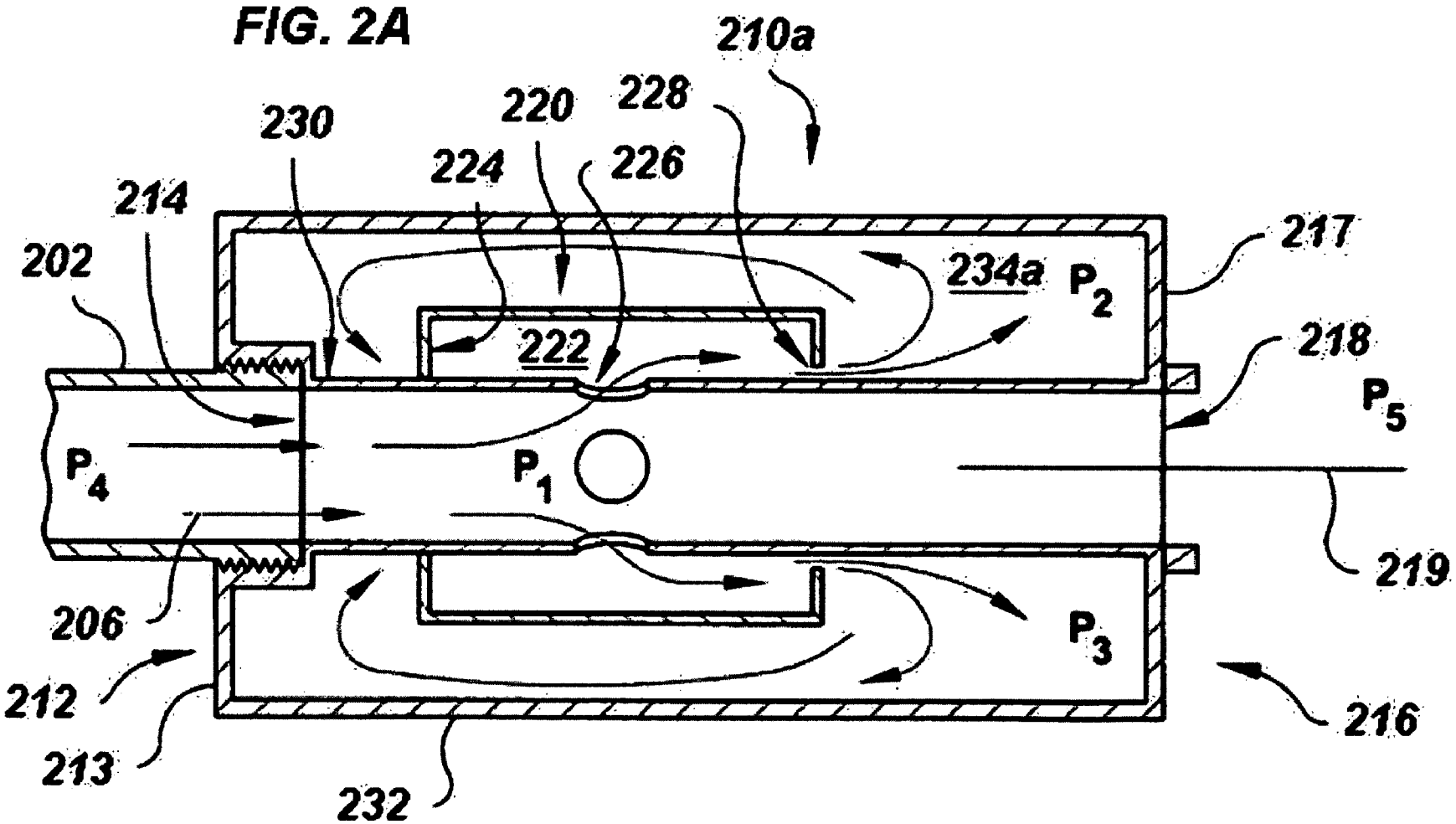
FIGS. 2A and 2B are cut-away side views of an embodiment of a muffler.
Figure 2B:
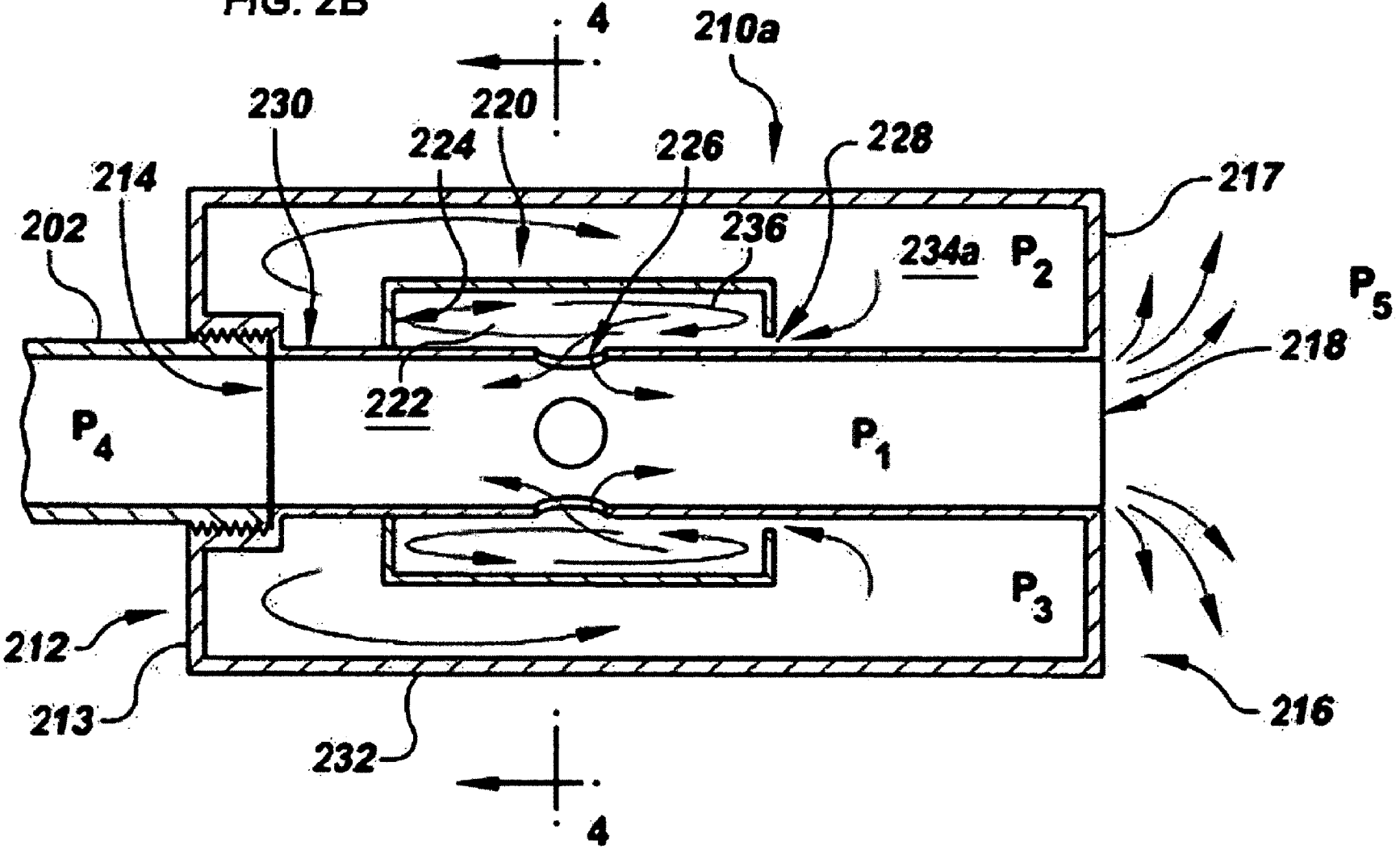
Figure 3A:
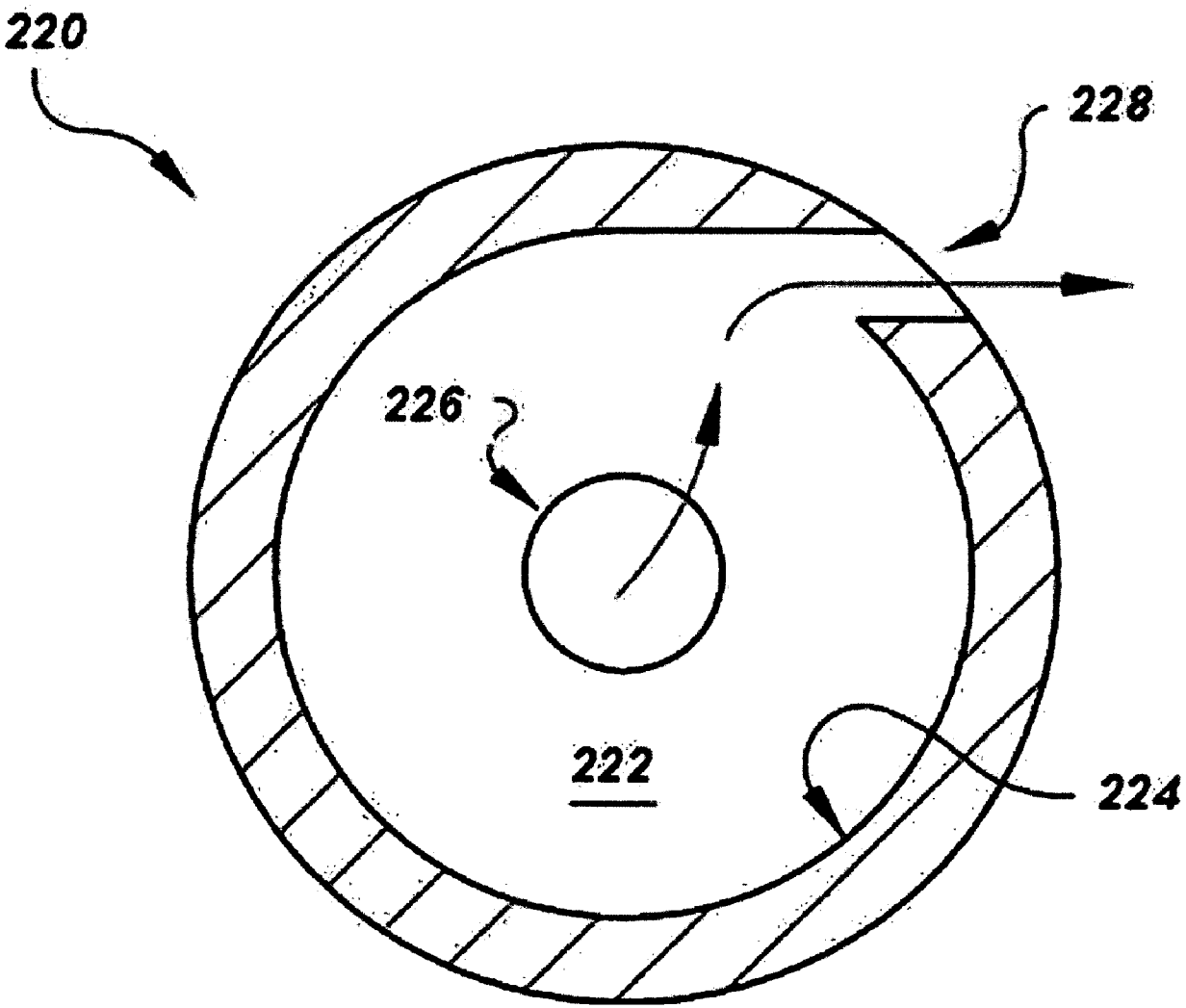
FIGS. 3A and 3B are schematic illustrations of an embodiment of a vortex chamber showing internal fluid flow.
Figure 3B:
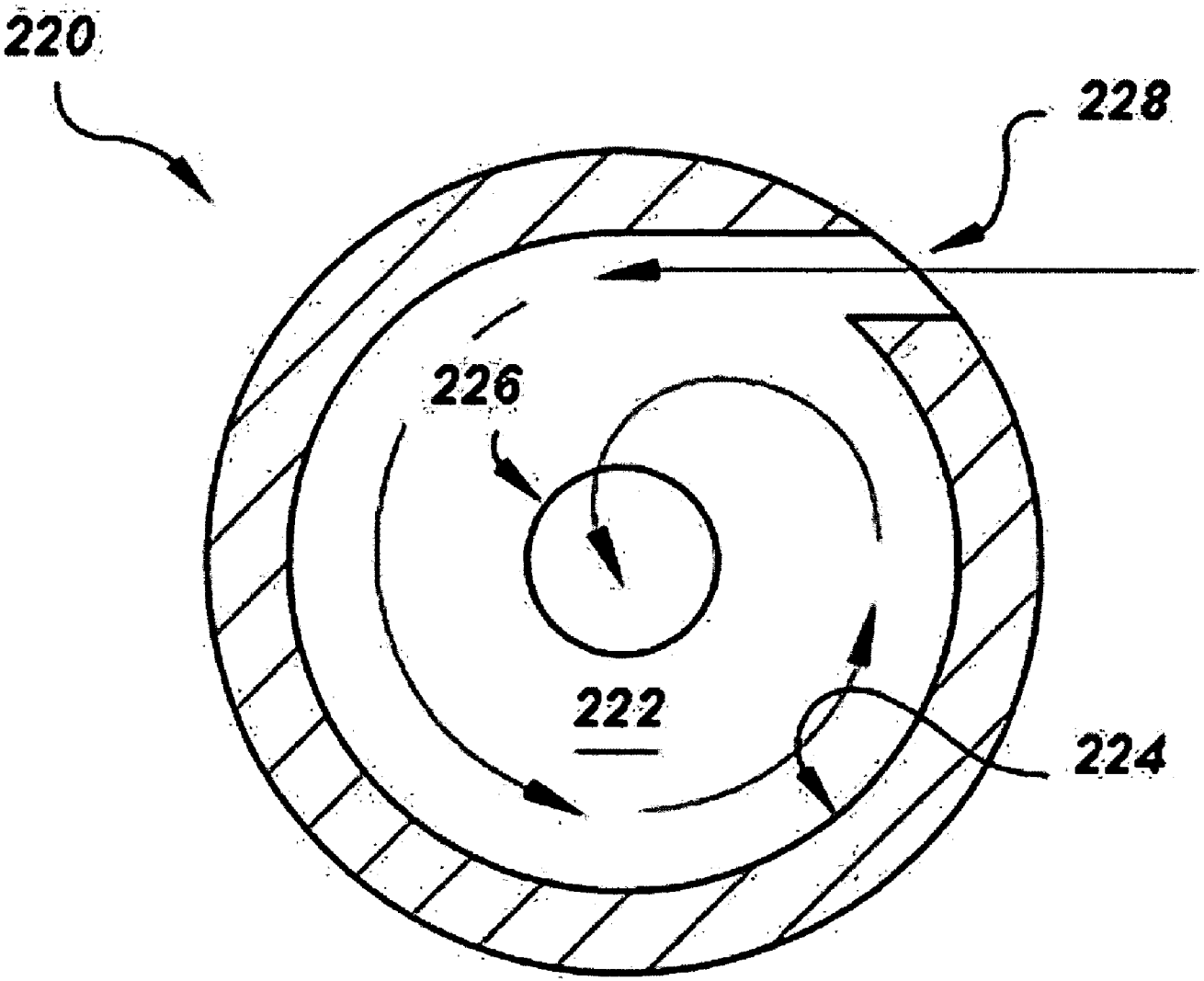
Figure 4:
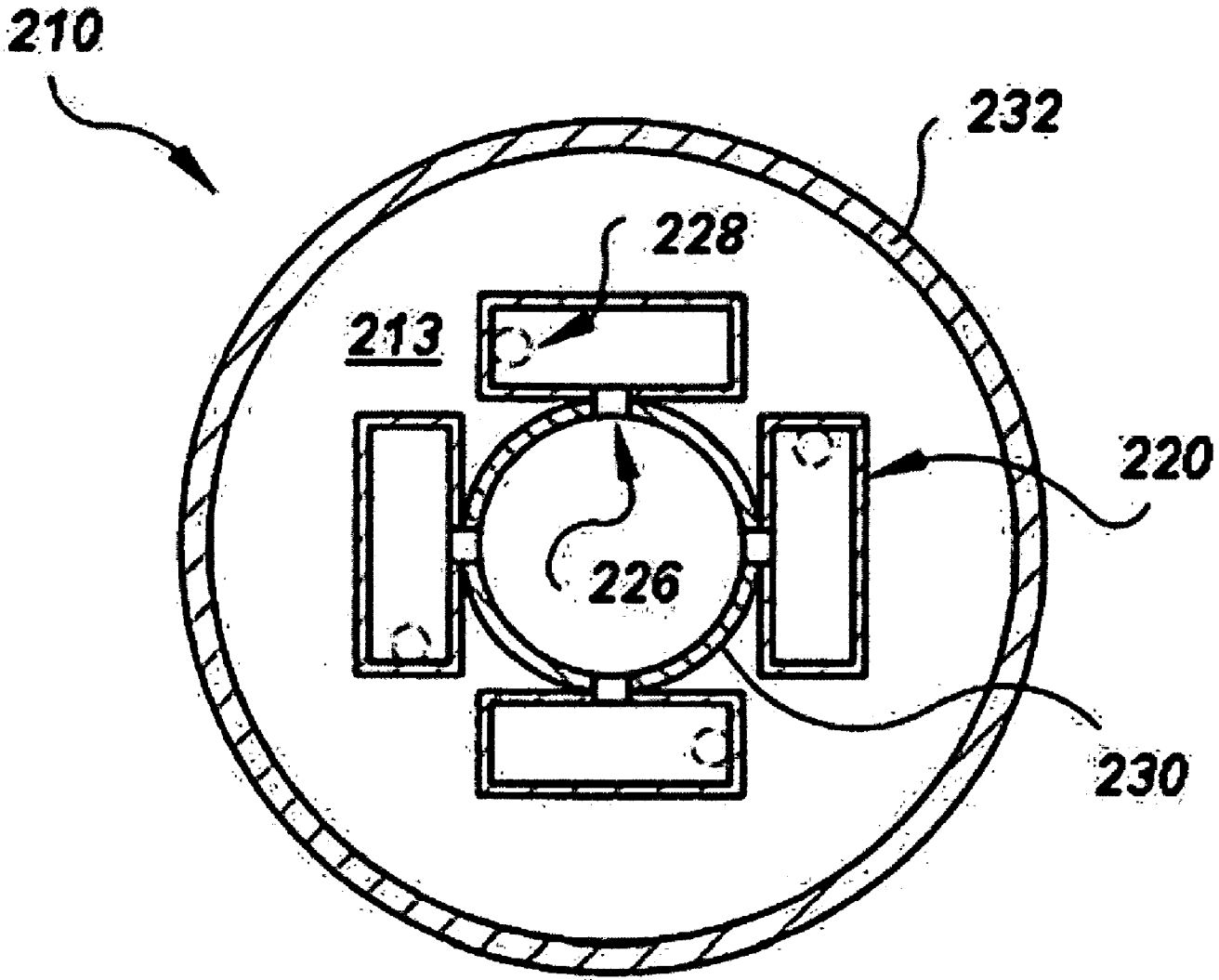
FIG. 4 is a cross-sectional view of the muffler as shown in FIGS. 2A and 2B, along line 4-4 of FIG. 2B.

Embodiments of mufflers for reducing the amplitude of engine noise transmitted to the atmosphere of a vehicle exhaust system are discussed. FIG. 1 depicts an exemplary embodiment of a muffler as would be disposed on a vehicle exhaust system. FIGS. 2A-2B and 4 depict an exemplary embodiment of a muffler of the disclosure. The principles of operation of an embodiment of a vortex diode are depicted in FIGS. 3A-3B. The remaining figures depict other exemplary embodiments of mufflers.

Referring now to FIG. 1, an embodiment of a vehicle exhaust system 200 is depicted including an embodiment of a muffler 210. Specifically, the muffler 210 is attached to the exhaust pipe 202 of the vehicle exhaust system 200. Although the vehicle exhaust system 200 is attached to a vehicle, embodiments of mufflers may be used with other types of high pressure systems, such as pressurized tools and industrial equipment.

FIGS. 2A and 2B depict another embodiment of a muffler. As shown, the muffler 210*a* includes a proximal end 212 including an entry opening 214, and a distal end 216 including a discharge opening 218. Preferably, the proximal end 212 and the distal end 216 are configured to be attached to the ends of the pipes of a vehicle exhaust system, such as pipe 202 of FIG. 1. By way of example, pipe clamps are preferably used. The longitudinal axis of the pipe 202 and the muffler 210*a* form a single longitudinal axis, or exhausting gas path 219. While the discharge opening 218 is shown discharging from the center of the distal end of the muffler, this is merely exemplary as various configurations are possible. Preferably, an inner cylindrical wall 230 extends from the entry opening 214 to the discharge opening 218 about the exhausting gas path 219. An outer housing 232 is disposed about the inner cylindrical wall 230, thereby forming an expansion chamber 234*a*. Preferably, although not necessarily, the proximal end 212 and distal end 216 of the muffler 210*a* are formed by a first wall 213 and a second wall 217, respectively, that are substantially parallel. As such, the first wall 213, the second wall 217, the inner cylindrical wall 230, and the outer housing 232 form a cylindrical expansion chamber 234*a*. Preferably, materials used in constructing the muffler have desirable heat conduction/absorption properties to help remove energy from the expanding combustion gasses.

Preferably, the muffler 210*a* includes a plurality of vortex diodes 220 disposed on the inner cylindrical wall 230 (FIG. 4). Each vortex diode 220 includes a circular peripheral wall 224 defining a substantially cylindrical vortex chamber 222, a vent 226, and a nozzle 228 formed in the circular peripheral wall 224. Many mufflers require multiple passes within the total enclosure to improve noise abatement. While FIGS. 2A and 2B show an exemplary straight line flow, the multiple vortex diode concepts could be applied along more complex flow patterns. While a plurality of 180-degree pipe bends with added straight sections would increase the total path length within the muffler, bends of this magnitude would greatly increase the backpressure, and it is important not to increase the backpressure on the engine such that it unnecessarily impedes engine performance; therefore, such complex flow patterns must take into account the degree to which they increase backpressure.

As shown in FIG. 3A, the circular peripheral wall 224 is disposed about the vent 226 and the nozzle 228 is formed tangential to the circular peripheral wall 224. Embodiments are envisioned wherein multiple nozzles 228 are positioned at various points around the circular peripheral wall 224, each providing a tangential input to the chamber. As such, combustion gasses, flowing in the direction of the flow arrows, enter the vortex diode 220 through the vent 226 and pass through the vortex chamber 222 directly out the nozzle 228. Fluid flow in this direction is restricted only by the cross sections of the vent 226 and nozzle 228.

In contrast, combustion gasses flowing in the direction of the flow arrows shown in FIG. 3B first pass through the nozzle 228, thereby entering the vortex chamber 222 tangentially to the circular peripheral wall 224. As such, the fluid is forced to spiral, creating a vortex prior to exiting through the vent 226. As is evident from FIG. 3B, the circular shape of the vortex chamber 222 provides an angular acceleration to the tangentially flowing fluid. The resultant angular velocity of the fluid causes the formation of the vortex within the vortex chamber 222, thereby restricting the exit flow of the fluid through the vent 226.

As shown in FIG. 2A, one or more vortex diodes 220 are disposed within the muffler 210*a* such that the vortex chamber 222 is in fluid communication with the exhausting gas path 219 by way of the vent 226 and the expansion chamber 234*a* by way of the nozzle 228. Therefore, during the expulsion of combustion gasses 206 from a vehicle exhaust system 200, the gasses will be allowed to freely expand into the expansion chamber 234*a* by flowing through the vent 226, through the vortex chamber 222, and out the nozzle 228, as previously discussed with regard to FIG. 3A. For example, as shown in FIG. 2A, as the combustion gasses 206 are urged along the exhausting gas path 219 by expansion and the continuous introduction into the vehicle exhaust system of additional combustion gasses as each succeeding cycle of combustion is completed in the vehicle engine, the combustion gasses 206 will eventually reach a location within the muffler 210*a* where they are allowed to pass through the vortex diodes 220 with minimal resistance and into the expansion chamber 234*a*.

To facilitate the flow of gasses into the expansion chamber 234*a*, a pressure bleed port or ports (not shown) can be positioned toward the distal end 216, thereby removing any "block-loaded" pressure condition and reducing the input impedance of gasses into the chamber 234*a*. An exemplary port could be a simple hole or could also be a vortex diode that will change resistance significantly when the chamber begins to become pressurized. Another possible location for such a pressure bleed port could be between adjacent chambers 234*a*, should there be more than one, with the fluid communication path eventually leading to the discharge part 218.

Once the combustion gasses 206 have passed into the expansion chamber 234*a*, the pressures within the vehicle exhaust system 200 and the muffler 210*a* represented by P1, P2, P3, and P4 are substantially equal and greater than the ambient pressure represented by P5. Note however, although greater than ambient pressure P5, those pressures represented by P1 through P4 are substantially less than the pressure exhibited by combustion gasses leaving exhaust pipe 202 of vehicle exhaust system 200 when the muffler 210*a* is not used.

As shown in FIG. 2B, as the combustion gasses 206 leave muffler 210*a* and the pressures P1 and P4 approach ambient pressure P5, pressures P2 and P3 are now greater than pressures P1 and P4. As such, the higher pressure combustion gasses present in the expansion chamber 234*a* will flow to the lower pressure region represented by pressures P1 and P4 by flowing through the vortex diodes 220. Each vortex diode 220 now slows the depressurization of the expansion chamber 234*a* by inducing a vortex, represented by flow arrows 236, on the combustion gasses as they flow first through the nozzle 228, tangentially about the vortex chamber 222, and eventually to the atmosphere through the vent 226 and then the discharge opening 218. As such, each vortex diode 220 not only aids in reducing the peak pressure of the combustion gasses released to atmosphere, but also delays the depressurization of the expansion chamber 234*a*, thereby reducing the pressure variation at the distal end 216 of the muffler due to the fuel combustion cycle discharging combustion gasses into vehicle exhaust system 200. Additional versions of vortex diodes and chamber combinations can be placed within the same muffler for successive pressure drops.

Figure 5:
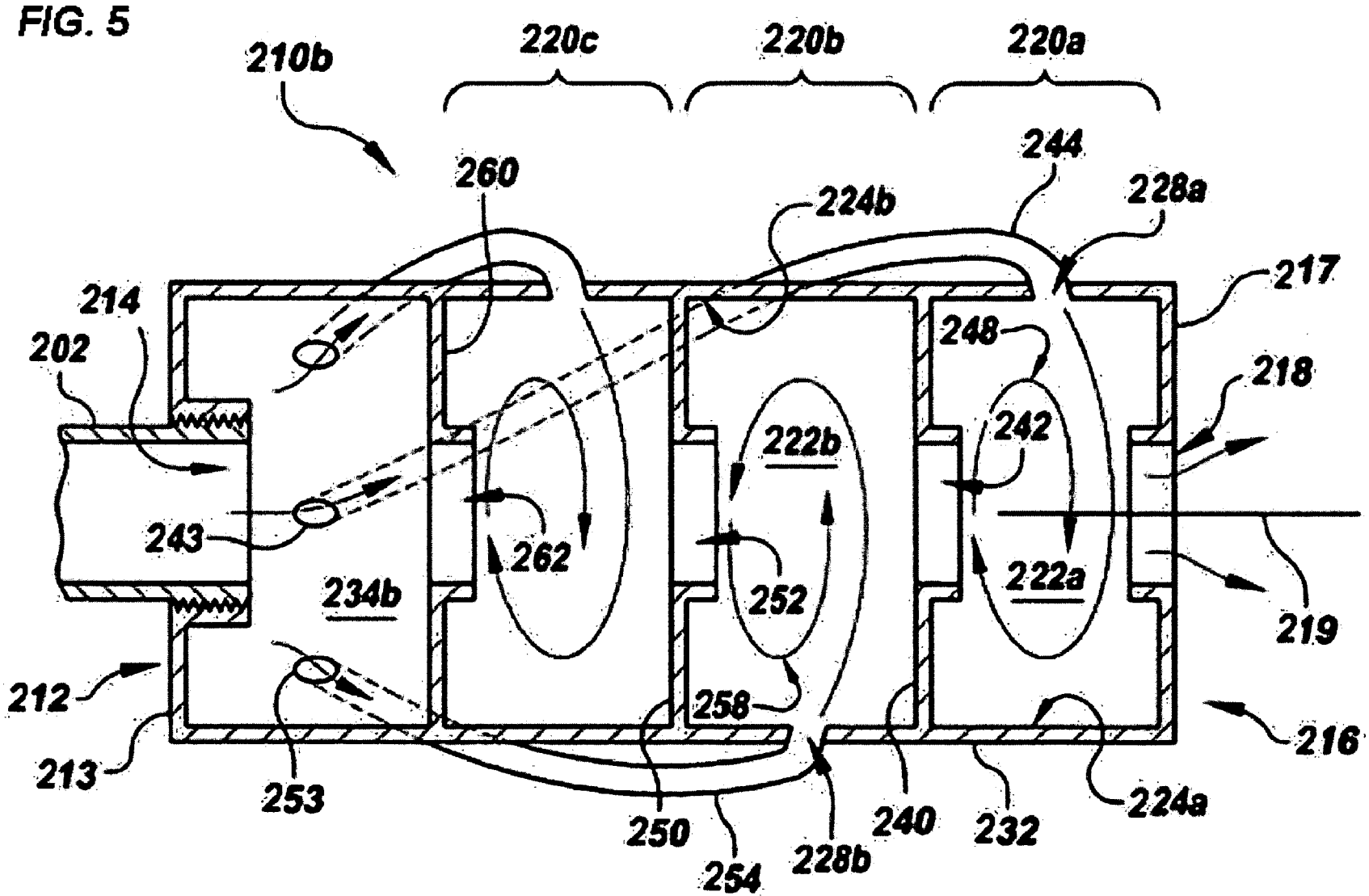
FIG. 5 is a cut-away side view of another embodiment of a muffler.

FIG. 5 depicts another embodiment of a muffler 210*b*. Preferably, the muffler 210*b* includes a proximal end 212 and a distal end 216. The proximal end is formed by a first wall 213 including an entry opening 214, and the distal end is formed by a second wall 217 including a discharge opening 218. The entry opening 214 and discharge opening 218 are both disposed about the exhausting gas path 219. A cylindrical outer housing 232 extends from the first wall 213 to the second wall 217 about the exhausting gas path 219, such that the muffler 210*b* forms a preferably cylindrical volume. As shown, the muffler 210*b* includes a first vortex diode 220*a*, a second vortex diode 220*b*, and a third vortex diode 220*c*. Note, embodiments of the muffler 210*b* are envisioned that include as few as one vortex diode 220, as well as numbers of vortex diodes 220 greater than that shown. For ease of description, only the operation of first vortex diode 220*a* and second vortex diode 220*b* will be discussed.

As shown, the first vortex diode 220*a* includes a vortex chamber 222*a* formed by the second wall 217, a first partition 240, and a circular peripheral wall 224*a*. The circular peripheral wall 224*a* is preferably the inner surface of the outer housing 232. The first vortex diode 220*a* also includes a nozzle 228*a* configured to introduce combustion gasses tangentially to the circular peripheral wall 224*a*, and a vent, the function of which is performed by the discharge opening 218 of the second wall 217. Similarly, the second vortex diode 220*b* is formed between the first partition 240 and a second partition 250, and includes a circular peripheral wall 224*b* and a nozzle 228*b* for introducing combustion gasses tangential to the circular peripheral wall 224*b*. Note, the dimensions of the various vortex chambers do not need to be uniform with respect to other vortex chambers within the same muffler.

A first exhausting gas aperture 242 formed in the first partition 240 functions as the vent for the second vortex diode 220*b*. A third vortex diode 220*c* is similarly formed between a third partition 260 and the second partition 250. The first exhausting gas aperture 242, the second exhausting gas aperture 252, and a third exhausting gas aperture 262 formed in the third partition 260 are all disposed along and about the exhausting gas path 219.

As shown, the proximal end 212 of the muffler 210*b* includes an expansion chamber 234*b* formed between the third partition 260, the first wall 213, and a portion of the outer housing 232. As shown, the expansion chamber 234*b* is a cylindrical volume, although this is not necessary for all embodiments. Preferably, a first fluid conduit 244 extends from an inlet 243 in the outer wall of the expansion chamber 234*b* to the nozzle 228*a* of the first vortex diode 220*a*. Note, the first fluid conduit 244 does not need to be outside the muffler 210*b*, as shown. Rather, the fluid conduit 244 could be fashioned to conduct flows internal to the outer housing 232 in voids created by walls 224*a,b,c* (not shown). Similarly, a second conduit 254 extends from an inlet 253 formed in the outer wall of the expansion chamber 234*b* to the nozzle 228*b* of the second vortex diode 220*b*. The first and second conduits 244, 254 allow combustion gasses, as indicated by the flow arrows, to flow from the expansion chamber 234*b* to their respective vortex diodes 220*a*, 220*b*.

When the vehicle engine is running, the exhausting gas (not shown) will eventually reach the vicinity of the third exhausting gas aperture 262. At this point, the combustion gasses that have been propelled out of exhaust pipe 202 pass into the expansion chamber 234*b* where at least a portion of the combustion gasses exit through first and second inlets 243, 253 and travel down the first and second conduits 244, 254 into the first and second vortex diodes 220*a*, 220*b*, respectively. The combustion gasses that reach the first vortex diode 120*a* are introduced to the vortex chamber 222*a* tangentially to the circular peripheral wall 224*a*. As such, a first vortex 248 is induced, thereby delaying the escape of the combustion gasses from the muffler 210*b* by way of the discharge opening 218. Similarly, the combustion gasses that reach the second vortex chamber 222*b* are introduced tangentially to the circular peripheral wall 224*b* through nozzle 228*b*, thereby forming a second vortex 258. Thus, the escape of the combustion gasses through the first exhausting gas aperture 242, and ultimately to the atmosphere, is delayed. Note, embodiments of the muffler 210*b* are envisioned wherein the conduits pass through the various partitions to their respective vortex diodes rather than being external to the outer housing 232. Additional internal helical baffles (not shown) can optionally be added to the proximal and distal ends of each vortex chamber to initiate swirl to the expanding gasses prior to any additional circulation being induced by the nozzles. These baffles could be configured similar to turbine blade shapes that redirect the expanding fluids in the same direction of the induced swirl of the vortex diode.

Figure 6:
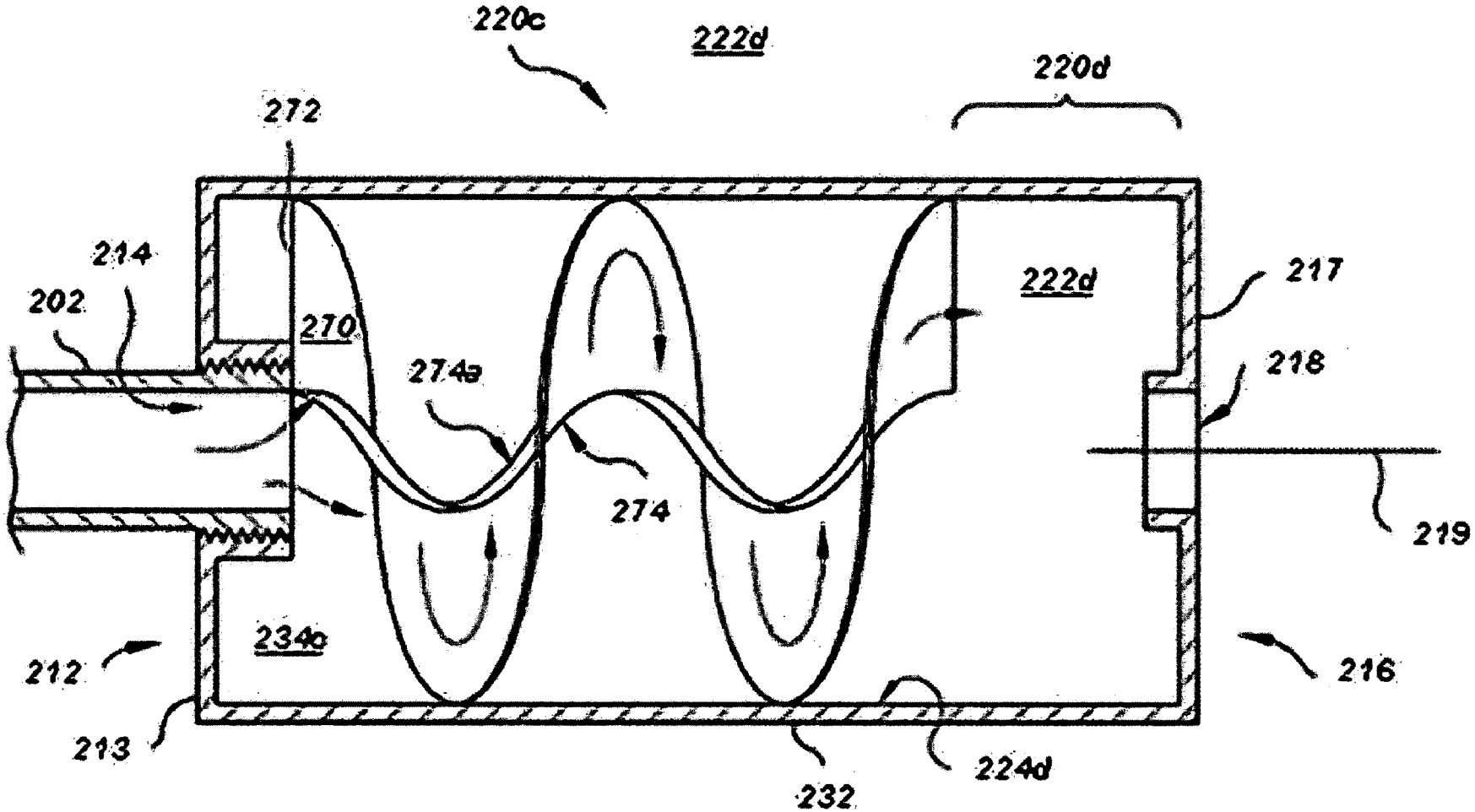
FIG. 6 is a cut-away side view of another embodiment of a muffler.

Another embodiment of a muffler 210*c* is depicted in FIG. 6. As shown, the muffler 210*c* includes a proximal end 212 and a distal end 216, the proximal end being formed by a first wall 213 including an entry opening 214, and the distal end being formed by a second wall 217 including a discharge opening 218. A cylindrical outer housing 232 extends from the first wall 213 to the second wall 217, thereby forming a cylindrical expansion chamber. The entry opening 214, the discharge opening 218, and the outer housing 232 are disposed about the exhausting gas path 219. As shown, the muffler 210*c* also includes a helically-shaped baffle 270 extending from the proximal end 212 for a portion of the length of the muffler 210*c*. The helically-shaped baffle 270 contacts the first wall 213. However, the helically-shaped baffle 270 can be spaced from the first wall 213 in other embodiments.

The muffler 210*c* functions under the vortex diode flow principles previously described to reduce the amplitude of the sound of engine combustion in a vehicle exhaust system. In the embodiment shown, a vortex diode 220*d* includes a vortex chamber 222*d* formed by the cylindrical volume of the muffler 210*c*, a circular peripheral wall 224*d* formed by the inner surface of the outer housing 232, and a vent as formed by the discharge opening 218. The function of a nozzle is performed by the helically-shaped baffle 270. As an exhausting gas exits the pipe 202 of the vehicle exhaust system, the combustion gasses enter the vortex chamber 222*d* of the vortex diode 220*d*, where they encounter the helically-shaped baffle 270. Preferably, the helically-shaped baffle 270 includes an outer edge 272 that is in contact with the circular peripheral wall 224*d* and an inner edge 274 which is adjacent the exhausting gas path 219.

Preferably, the inner edge 274 has an edge extension 274*a* that extends slightly in the direction toward the proximal end 212, whereby the edge extension 274*a* helps capture the expanding gasses and force containment and circulation outward along the helical baffle 270. As the combustion gasses encounter the helically-shaped baffle 270, an angular acceleration is imparted on the combustion gasses, causing the gasses to flow outwardly toward the circular peripheral wall 224*d*. As such, as the combustion gasses travel the length of the vortex chamber 222*d*, a vortex is induced, as shown by the flow arrows. Therefore, the helically-shaped baffle 270 has performed the function of a nozzle 228 (FIGS. 3A-3B) by inducing a vortex on the combustion gasses. Similar to the prior discussions, the induced vortex will contain the gasses within the chamber 222*d* due to outwardly expanding circular swirl and delay the escape of the expanding combustion gasses to atmosphere, thereby reducing the sound of engine combustion.

Figure 7:
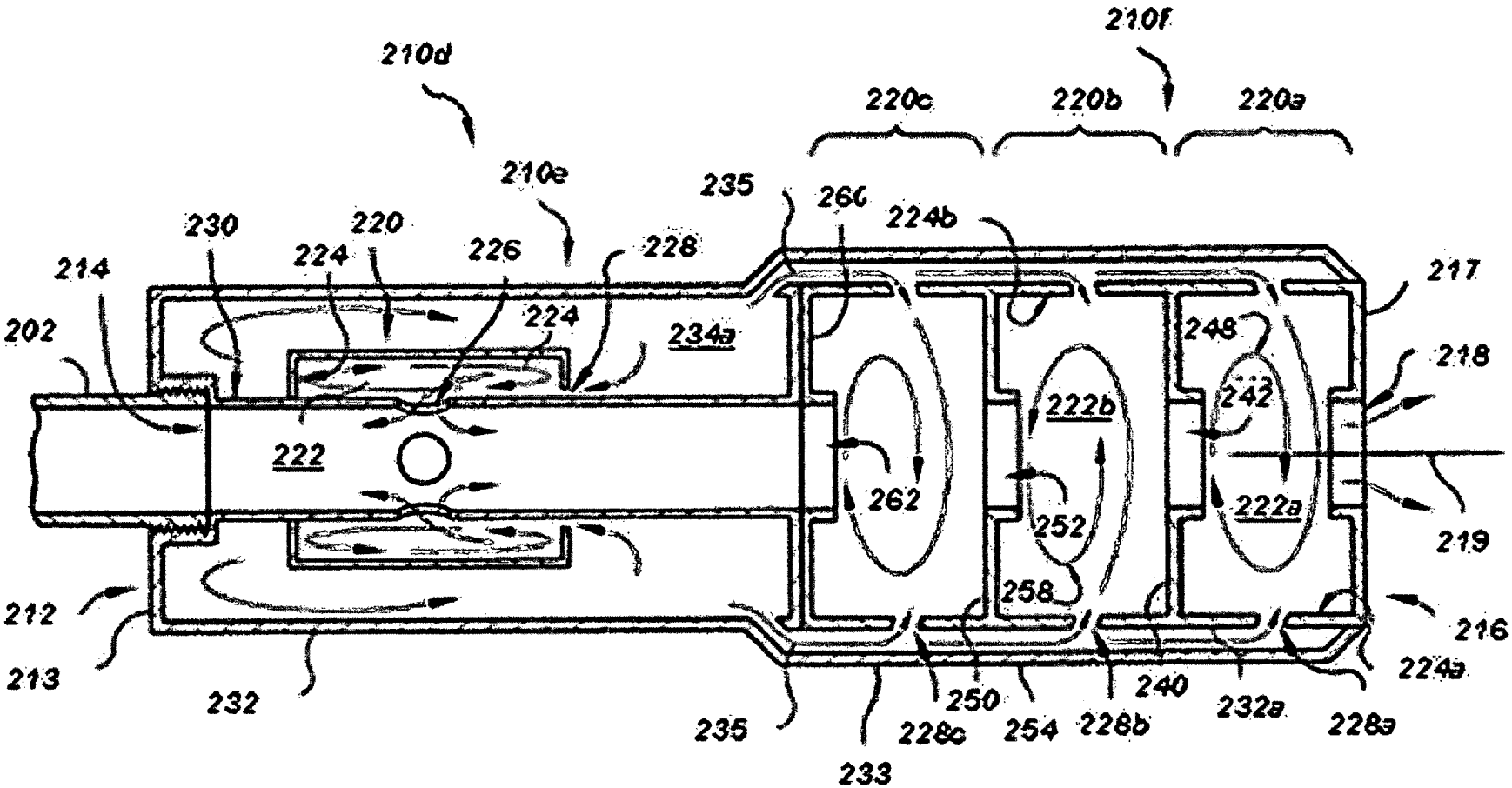
FIG. 7 is a cut-away side view of another embodiment of a muffler.

FIG. 7 depicts another embodiment of a muffler 210*d*. As shown, the muffler 210*d* includes a proximal end 212 including an entry opening 214, and a distal end 216 including a discharge opening 218. Preferably, the proximal end 212 is configured to be attached to the end of the pipe of a vehicle exhaust system, such as pipe 202. By way of example, clamps are preferably used. The longitudinal axis of the pipe 202 and the muffler 210*d* form a single longitudinal axis, or exhausting gas path 219. As shown, the muffler 210*d* includes a first stage 210*e* that functions similarly to the muffler 210*a* shown in FIGS. 2A-2B and 4, and a second stage 210*f* that functions similarly to the muffler 210*b* shown in FIG. 5. Note, however, that in the embodiment shown in FIG. 7, expansion chamber 234*b* has been replaced with the first stage 210*e*.

Preferably, an inner cylindrical wall 230 of the first stage 210*e* extends from the entry opening 214 to a third exhausting gas aperture 262 formed in a third partition 260 of the second stage 210*f*. An outer housing 232*a* is disposed about the inner cylindrical wall 230, thereby forming an expansion chamber 234*a*.

Preferably, the first stage 210*e* includes a plurality of vortex diodes 220 disposed on the inner cylindrical wall 230 (FIG. 4). Each vortex diode 220 includes a circular peripheral wall 224 defining a substantially cylindrical vortex chamber 222, a vent 226, and a nozzle 228 formed in the circular peripheral wall 224. Embodiments are envisioned wherein multiple nozzles 228 are positioned at various points around the circular peripheral wall 224, each providing a tangential input to the chamber.

Preferably one or more vortex diodes 220 are disposed within the first stage 210*e* such that the vortex chamber 222 is in fluid communication with the exhausting gas path 219 by way of the vent 226 and the expansion chamber 234*a* by way of the nozzle 228. Therefore, during the high-pressure pulsations passing through the vehicle exhaust system, combustion gasses will be allowed to freely expand into the expansion chamber 234*a* by flowing through the vent 226, through the vortex chamber 222, and out the nozzle 228, as previously discussed with regard to FIG. 3A. As the exhausting gas is urged along the exhausting gas path 219 by expansion and the continuous introduction into the vehicle exhaust system of additional combustion gasses as each succeeding cycle is completed in the vehicle engine the combustion gasses will eventually reach a point within the first stage 210*e* where they are allowed to pass through the vortex diodes 220 with minimal resistance and into the expansion chamber 234*a*.

Preferably, the second stage 210*f* of the muffler 210*d* includes a cylindrical outer housing 232 extending from the third partition 260 to the second wall 217, a first axially-disposed vortex diode 220*a*, a second axially-disposed vortex diode 220*b*, and a third axially-disposed vortex diode 220*c*. Note, embodiments of the muffler 210*d* are envisioned that include as few as one axially-disposed vortex diode 220*a-c*, as well as numbers of vortex axially-disposed diodes 220*a-c* greater than that shown. For ease of description, only the operation of first axially-disposed vortex diode 220*a* and second vortex diode 220*b* will be discussed.

As shown, the first axially-disposed vortex diode 220*a* includes a vortex chamber 222*a* formed by the second wall 217, a first partition 240 and a circular peripheral wall 224*a*. Preferably, the circular peripheral wall 224*a* is the inner surface of the outer housing 232. The first vortex diode 220*a* also includes at least one nozzle 228*a* configured to introduce combustion gasses tangentially to the circular peripheral wall 224*a*, and a vent, the function of which is performed by the discharge opening 218 of the second wall 217. Similarly, the second vortex diode 220*b* is formed between the first partition 240 and a second partition 250, and includes a circular peripheral wall 224*b* and at least one nozzle 228*b* for introducing combustion gasses tangential to the circular peripheral wall 224*b*. Note, the dimensions of the various vortex chambers do not need to be uniform with respect to other vortex chambers within the same muffler.

A first exhausting gas aperture 242 formed in the first partition 240 functions as the vent for the second vortex diode 220*b*. A third vortex diode 220*c* is similarly formed between a third partition 260 and the second partition 250. The first exhausting gas aperture 242, the second exhausting gas aperture 252, and a third exhausting gas aperture 262 formed in the third partition 260 are all disposed along and about the exhausting gas path 219. The inside diameters of exhausting gas apertures 242, 252, and 262 will ensure the exhausting gas travels through the apertures without excess restriction, but with minimal dimension to improve the effectiveness of the muffler 210*b*. By way of an example, the inner diameters of apertures 242, 252, and 262 can be equivalent to the inner diameter of distal end 218.

Control ports 235 bleed a portion of high pressure air from the expansion chamber 234*a* to a volume formed between the outer housing 232*a* and a second housing 233. As indicated by the flow arrows, combustion gasses are allowed to flow from the expansion chamber 234*a* to the axially-disposed vortex diodes 220*a-c* by way of the volume and the nozzles 228*a-c*.

The pulsating high-pressure combustion gasses that reach the first vortex diode 220*a* are introduced to the vortex chamber 222*a* tangentially to the circular peripheral wall 224*a*. As discussed in regard to FIG. 3B, a first vortex 248 is induced, thereby delaying the escape of the combustion gasses from the muffler 210*d* by way of the discharge opening 218. Similarly, the combustion gasses that reach the second vortex chamber 222*b* are introduced tangentially to the circular peripheral wall 224*b* through nozzle 228*b*, thereby forming a second vortex 258. The escape of the combustion gasses through the first exhausting gas aperture 242, and ultimately to the atmosphere, is delayed.

As the combustion gasses 206 leave the muffler 210*d* the higher pressure combustion gasses remaining in the expansion chamber 234*a* will flow to the lower pressure region along the flight path by flowing through the vortex diodes 220 of the first stage 210*e*. Each vortex diode 220 now slows the depressurization of the expansion chamber 234*a* by inducing a vortex, represented by flow arrows 236, on the combustion gasses as they flow first through the nozzle 228, tangentially about the vortex chamber 222, and eventually to the atmosphere through the vent 226 and then the discharge opening 218. As such, each vortex diode 220 not only aids in reducing the peak pressure of the combustion gasses released to atmosphere, but also delays the depressurization of the expansion chamber 234*a*, thereby reducing the pressure variation at the distal end 216 of the muffler due to the fuel combustion cycle discharging combustion gasses into vehicle exhaust system 202.

It should be recognized a muffler 210 can incorporate a plurality of mufflers 210*a* arranged in both series and parallel within one housing increasing the effectiveness of the noise abatement.

Note, although the mufflers that have been disclosed are for use in reducing the noise of a vehicle exhaust system, similar devices operating on similar principles can be used to quiet exhausting of high pressure fluids (gasses, liquids, gas/liquid combinations, etc.) in industrial equipment, generators, and other manufacturing equipment to include high pressure fluids containing particulate matter in suspension or solution.

The foregoing description has been presented for purposes of illustration and description. It is not intended to be exhaustive or to limit the present disclosure to the precise forms disclosed. Modifications and/or variations are possible in light of the above teachings. The embodiments discussed, however, were chosen and described to illustrate the principles of the present disclosure and its practical application to thereby enable one of ordinary skill in the art to utilize the present disclosure and various embodiments and with various modifications as are suited to the particular use contemplated. All such modifications and/or variations are within the scope of the present disclosure as determined by the appended claims when interpreted in accordance with the breadth to which they are fairly and legally entitled.

What is claimed is:

1. A muffler for a vehicle exhaust system having a combustion chamber and a pipe, the vehicle exhaust system being configured to release combustion gasses generated in the combustion chamber, the muffler comprising:

a proximal end and a distal end, the proximal end being configured for mounting the muffler to an engine exhaust pipe and including an entry opening, the distal end including a discharge opening configured to allow the combustion gasses to pass therethrough, and defining a exhausting gas path therebetween;

an inner cylindrical wall disposed about the exhausting gas path;

an outer housing disposed concentrically about the inner cylindrical wall;

an expansion chamber formed by the inner cylindrical wall, the outer housing, the proximal end and the distal end of the muffler; and at least one vortex chamber disposed between the proximal end and the distal end, the at least one vortex chamber including:

a vent disposed on the inner cylindrical wall;

a circular peripheral wall being disposed concentrically about the vent;

a nozzle disposed on the circular peripheral wall; and wherein the circular peripheral wall is operative to induce a vortex on at least a portion of the combustion gasses expelled from the combustion chamber during engine operation, the vortex impeding flow of the combustion gasses from the pipe such that the acoustic energy associated with the release of the combustion gasses is dissipated.

2. A muffler for a vehicle exhaust system having a combustion chamber and an exhaust pipe, the vehicle exhaust system being configured to dissipate combustion gasses generated in the combustion chamber, the muffler comprising:

a proximal end and a distal end, the proximal end being configured for mounting the muffler to the exhaust pipe, the distal end being configured to allow the combustion gasses to pass therethrough;

at least one vortex chamber disposed between the proximal end and the distal end, the at least one vortex chamber including a circular peripheral wall for inducing a vortex on at least a portion of the combustion gasses expelled from the combustion chamber during operation of a vehicle engine, the vortex impeding flow of the combustion gasses from the exhaust pipe such that acoustic energy associated with the release of the combustion gasses is dissipated;

an entry opening disposed on the proximal end of the muffler;

a discharge opening disposed on the distal end of the muffler;

wherein the entry opening and discharge opening are located along a longitudinal axis of the exhaust pipe and define an exhausting gas path therebetween;

an inner cylindrical wall disposed about the exhausting gas path;

an outer housing disposed about the inner cylindrical wall;

an expansion chamber formed by the inner cylindrical wall, the outer housing, the proximal end and the distal end of the muffler;

wherein the at least one vortex chamber further comprises a first vortex chamber, the first vortex chamber being in fluid communication with both the exhausting gas path and the expansion chamber;

a vent disposed on the inner cylindrical wall, the circular peripheral wall being disposed concentrically about the vent, the vent being configured to allow combustion gasses to flow between the vortex chamber and the exhausting gas path, and a nozzle disposed on the circular peripheral wall, wherein the nozzle is configured to introduce a first portion of the combustion gasses into the first vortex chamber tangentially to the circular peripheral wall.

3. The muffler of claim 2, wherein a central longitudinal axis of the first vortex chamber is perpendicular to the exhausting gas path.

4. A muffler for a vehicle exhaust system having a combustion chamber and an exhaust pipe, the vehicle exhaust system being configured to dissipate combustion gasses generated in the combustion chamber, the muffler comprising:

a proximal end and a distal end, the proximal end being configured for mounting the muffler to the exhaust pipe, the distal end being configured to allow the combustion gasses to pass therethrough;

at least one vortex chamber disposed between the proximal end and the distal end, the at least one vortex chamber including a circular peripheral wall for inducing a vortex on at least a portion of the combustion gasses expelled from the combustion chamber during operation of a vehicle engine, the vortex impeding flow of the combustion gasses from the exhaust pipe such that acoustic energy associated with the release of the combustion gasses is dissipated;

an entry opening disposed on the proximal end of the muffler;

a discharge opening disposed on the distal end of the muffler;

wherein the entry opening and discharge opening are located along a longitudinal axis of the exhaust pipe and define an exhausting gas path therebetween; and wherein the circular peripheral wall is disposed about the exhausting gas path;

a first partition defining a first exhausting gas aperture, the first partition being disposed between the proximal end and the distal end of the muffler such that the first exhausting gas aperture is disposed about the exhausting gas path;

an expansion chamber disposed between the proximal end and the first partition;

a first conduit having a proximal end and a distal end, the proximal end of the first conduit being in fluid communication with the expansion chamber; and wherein the at least one vortex chamber further comprises a first vortex chamber; and wherein the distal end of the first conduit is in fluid communication with the first vortex chamber and is configured to introduce a first portion of the combustion gasses into the first vortex chamber such that a first vortex is formed.

5. The muffler of claim 4, wherein the distal end of the first conduit is configured to introduce the first portion of the combustion gasses tangentially to the circular peripheral wall.

6. The muffler of claim 4, further comprising:

a second partition defining a second exhausting gas aperture, the second partition being disposed between the first partition and the distal end of the muffler such that the second exhausting gas aperture is disposed about the exhausting gas path, the first vortex chamber is disposed between the first partition and the second partition, and a second vortex chamber is disposed between the second partition and the distal end of the muffler;

a second conduit having a proximal end and a distal end, the proximal end of the second conduit being in fluid communication with the expansion chamber; and wherein the distal end of the second conduit is in fluid communication with the second vortex chamber and is configured to introduce a second portion of the combustion gasses into the second vortex chamber such that a second vortex is formed.

7. The muffler of claim 6, wherein the first vortex and the second vortex rotate in opposing directions relative to the exhausting gas path.

8. A muffler for a vehicle exhaust system having a combustion chamber and an exhaust pipe, the vehicle exhaust system being configured to reduce the amplitude of acoustic energy of combustion gasses generated in the combustion chamber, the muffler comprising:

a proximal end forming an entry opening and a distal end forming a discharge opening, the proximal end being configured for mounting the muffler to the exhaust pipe, the distal end being configured to allow the combustion gasses to pass therethrough, the entry opening and discharge opening being located along a longitudinal axis of the exhaust pipe and defining an exhaust gas path therebetween;

a first stage including:

an inner cylindrical wall disposed about a portion of the exhaust gas path;

an outer housing disposed about the inner cylindrical wall;

an expansion chamber formed between the inner cylindrical wall and the outer housing;

a first vortex chamber disposed within the expansion chamber, the first vortex chamber including a first circular peripheral wall for inducing a vortex on at least a portion of the combustion gasses expelled from the combustion chamber during high-pressure pulsation cycles produced during the operation of a vehicle engine, the first vortex chamber being in fluid communication with both the exhaust gas path and the expansion chamber; and a second stage including:

a second vortex chamber including a second circular peripheral wall for inducing a vortex on at least a portion of the combustion gasses expelled from the combustion chamber, the second circular peripheral wall being concentric about the exhaust gas path; and wherein the second vortex chamber is in fluid communication with the expansion chamber;

a vent disposed on the inner cylindrical wall, the first circular peripheral wall being disposed concentrically about the vent, the vent being configured to allow combustion gasses to flow between the vortex chamber and the exhaust gas path, and a nozzle disposed on the first circular peripheral wall, wherein the nozzle is configured to introduce a portion of the combustion gasses into the first vortex chamber tangentially to the circular peripheral wall.

9. A muffler for a vehicle exhaust system having a combustion chamber and an exhaust pipe, the vehicle exhaust system being configured to reduce the amplitude of acoustic energy of combustion gasses generated in the combustion chamber, the muffler comprising:

a proximal end forming an entry opening and a distal end forming a discharge opening, the proximal end being configured for mounting the muffler to the exhaust pipe, the distal end being configured to allow the combustion gasses to pass therethrough, the entry opening and discharge opening being located along a longitudinal axis of the exhaust pipe and defining an exhaust gas path therebetween;

a first stage including:

an inner cylindrical wall disposed about a portion of the exhaust gas path;

an outer housing disposed about the inner cylindrical wall;

an expansion chamber formed between the inner cylindrical wall and the outer housing;

a first vortex chamber disposed within the expansion chamber, the first vortex chamber including a first circular peripheral wall for inducing a vortex on at least a portion of the combustion gasses expelled from the combustion chamber during high-pressure pulsation cycles produced during the operation of a vehicle engine, the first vortex chamber being in fluid communication with both the exhaust gas path and the expansion chamber; and a second stage including:

a second vortex chamber including a second circular peripheral wall for inducing a vortex on at least a portion of the combustion gasses expelled from the combustion chamber, the second circular peripheral wall being concentric about the exhaust gas path; and wherein the second vortex chamber is in fluid communication with the expansion chamber;

the second stage further comprising:

a first partition defining a first exhaust gas aperture, the first partition being disposed between the first stage and the distal end of the muffler such that the first exhaust gas aperture is disposed about the exhaust gas path;

a first conduit having a proximal end and a distal end, the proximal end of the first conduit being in fluid communication with the expansion chamber; and wherein the distal end of the first conduit is in fluid communication with the second vortex chamber and is configured to introduce a portion of the combustion gasses into the second vortex chamber such that a vortex is formed.

* * * * *